US012467680B2

(12) United States Patent
Yang et al.

(10) Patent No.: US 12,467,680 B2
(45) Date of Patent: Nov. 11, 2025

(54) DEFROST CONTROL METHOD AND HEAT PUMP SYSTEM

(71) Applicant: Carrier Corporation, Palm Beach Gardens, FL (US)

(72) Inventors: Min Yang, Shanghai (CN); Weijuan Wang, Shanghai (CN); Jingkai Weng, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 801 days.

(21) Appl. No.: 16/270,833

(22) Filed: Feb. 8, 2019

(65) Prior Publication Data

US 2019/0249916 A1 Aug. 15, 2019

(30) Foreign Application Priority Data

Feb. 9, 2018 (CN) ..... 201810132393.X

(51) Int. Cl.
*F25D 21/00* (2006.01)
*F24F 11/42* (2018.01)
(Continued)

(52) U.S. Cl.
CPC ..... *F25D 21/008* (2013.01); *F24F 11/42* (2018.01); *F24F 11/63* (2018.01); *F24F 11/64* (2018.01); *F25B 13/00* (2013.01); *F25B 47/02* (2013.01)

(58) Field of Classification Search
CPC .. F24F 11/64; F24F 11/42; F24F 11/63; F24F 11/41; F24F 11/65; F24F 11/84; F24F 2110/10
See application file for complete search history.

(56) References Cited

U.S. PATENT DOCUMENTS 4,328,680 A * 5/1982 Stamp, Jr. ..... F25D 21/006 62/155
4,573,326 A 3/1986 Sulfstede et al.
(Continued)

FOREIGN PATENT DOCUMENTS

CN 102829527 A 12/2012
CN 103574832 A 2/2014
(Continued)

OTHER PUBLICATIONS

European Search Report for application 19156475.6, dated Jul. 2, 2019, 116 pages.

*Primary Examiner* — Larry L Furdge
(74) *Attorney, Agent, or Firm* — CANTOR COLBURN LLP

(57) ABSTRACT

A defrosting control method comprises: initializing a first default parameter $TM_n$ and a second default parameter $TN_n$ in a preset defrosting interval indicatrix X when a heat pump system runs, wherein the preset defrosting interval indicatrix $X=T_1/TM_n+T_2/TN_n$; executing the defrosting cycle when the preset defrosting interval indicatrix X is greater than or equal to a preset constant value, and terminating the defrosting cycle after a defrosting cycle exit condition is met; obtaining an actual time spent on the defrosting cycle; comparing the actual time spent on the defrosting cycle with an expected defrosting time, and adjusting the first default parameter and the second default parameter when the actual defrosting time deviates from the expected defrosting time.

7 Claims, 2 Drawing Sheets

(51) Int. Cl.

| | |
|---|---|
| ***F24F 11/63*** | (2018.01) |
| ***F24F 11/64*** | (2018.01) |
| ***F25B 13/00*** | (2006.01) |
| ***F25B 47/02*** | (2006.01) |

(56) References Cited

U.S. PATENT DOCUMENTS

| | | | | |
|---|---|---|---|---|
| 4,938,027 | A * | 7/1990 | Midlang | F25D 21/008 62/153 |
| 5,493,867 | A | 2/1996 | Szynal et al. | |
| 6,138,464 | A | 10/2000 | Derosier et al. | |
| 7,654,098 | B2 | 2/2010 | Pham et al. | |
| 7,707,842 | B2 | 5/2010 | Concha | |
| 8,341,970 | B2 | 1/2013 | Ouchi et al. | |
| 9,068,771 | B2 | 6/2015 | Shah | |
| 9,243,834 | B2 | 1/2016 | Kim et al. | |
| 9,703,287 | B2 | 7/2017 | Arensmeier | |
| 9,829,232 | B2 | 11/2017 | Tsukino | |
| 2014/0352335 | A1* | 12/2014 | Anderson | F25D 21/008 62/80 |
| 2015/0027144 | A1 | 1/2015 | Lee et al. | |
| 2015/0211779 | A1* | 7/2015 | Brandt | F24F 11/30 62/80 |
| 2016/0178259 | A1 | 6/2016 | Kimura et al. | |
| 2017/0074537 | A1 | 3/2017 | Bentz et al. | |
| 2017/0184333 | A1 | 6/2017 | Lukasse | |
| 2018/0187936 | A1* | 7/2018 | Najima | F25B 41/046 |

FOREIGN PATENT DOCUMENTS

| | | | |
|---|---|---|---|
| CN | 105371587 | A | 3/2016 |
| CN | 105588267 | A | 5/2016 |
| CN | 107091548 | A | 8/2017 |
| CN | 107228451 | A | 10/2017 |
| WO | 2017050073 | A1 | 3/2017 |

* cited by examiner

DEFROST CONTROL METHOD AND HEAT PUMP SYSTEM

FOREIGN PRIORITY

This application claims priority to Chinese Patent Application No. 201810132393.X filed Feb. 9, 2018, and all the benefits accruing therefrom under 35 U.S.C. § 119, the contents of which in its entirety are herein incorporated by reference

TECHNICAL FIELD

This application relates to the field of heat pumps, and more specifically, to a defrosting control method for a heat pump system.

BACKGROUND ART

As very mature equipment, heat pump systems are widely applied in commercial buildings, household space, and many other places and can also provide relatively comfortable refrigerating/heating effects. However, engineers in this field are still devoting themselves to optimization and improvement in many aspects, one of which is to control a defrosting time and a defrosting interval.

Currently, the conventional defrosting control is carried out by setting a preset time interval in a heating mode and starting every defrosting cycle accordingly. This method is usually set for conventional environmental conditions. If the external temperature is relatively low, and humidity is relatively low, the external frosting degree may still be relatively low after the preset time interval. In this case, frequent defrosting affects user experience on one hand and causes energy waste on the other hand. On the contrary, if the external temperature is relatively high, and humidity is relatively high, the external frosting degree may have become very serious before the preset time interval arrives, and therefore defrosting is needed urgently. In this case, the thick frost may affect device performance on one hand, and on the other hand, the subsequent defrosting process also takes a long time, and bad user experience will be caused if the heating mode is off for a long time.

SUMMARY OF THE INVENTION

An objective of this application is to provide a defrosting control method for a heat pump system, through which a defrosting interval can be adjusted.

Another objective of this application is to provide a heat pump system capable of adjusting a defrosting interval.

To realize the objectives of this application, according to one aspect of this application, a defrosting control method for a heat pump system is provided, including: in S100, initializing a first default parameter $TM_n$ and a second default parameter $TN_n$ in a preset defrosting interval indicatrix X when a heat pump system runs, wherein the preset defrosting interval indicatrix $X=T_1/TM_n+T_2/TN_n$ $T_1$ represents a running time of the heat pump system when an outdoor temperature is greater than or equal to an outdoor temperature preset value, $T_2$ represents a running time of the heat pump system when the outdoor temperature is less than the outdoor temperature preset value, and n represents the number of executed defrosting cycles; in S200, executing the defrosting cycle when the preset defrosting interval indicatrix X is greater than or equal to a preset constant value, and terminating the defrosting cycle after a defrosting cycle exit condition is met; in S300, obtaining an actual time spent on the defrosting cycle; in S400, comparing the actual time spent on the defrosting cycle with an expected defrosting time, and adjusting the first default parameter and the second default parameter when the actual defrosting time deviates from the expected defrosting time; and in S500, repeating steps S200 to S400.

Optionally, the outdoor temperature preset value is −5° C. to 10° C.; and/or the first default parameter is 20 to 40; and/or the second default parameter is 40 to 80.

Optionally, when the defrosting cycle is executed for the $n^{th}$ time, $TM_n=TM_{n-1}+a*c$; and/or $TN_n=TN_{n-1}+a*c$, wherein a represents a preset time unit, and c represents a third default parameter.

[Optionally, when the actual defrosting time is less than the expected defrosting time, c=1; and/or when the actual defrosting time is equal to the expected defrosting time, c=0; and/or when the actual defrosting time is greater than the expected defrosting time, c=−1.

Optionally, the preset time unit a is set to 5 min to 10 min.

Optionally, when $TM_{n-1}+a*c<TM_{min}$, $TM_n$ is taken as a minimum value $TM_{min}$; and/or when $TN_{n-1}+a*c<TN_{min}$, $TN_n$ is taken as a minimum value $TN_{min}$ Optionally, $TM_{min}$=30 min; and/or $TN_{min}$=30 min.

Optionally, the preset constant value is 100%.

Optionally, the defrosting cycle exit condition is that a condenser temperature is greater than 12° C. to 16° C., or the actual defrosting time is greater than 6 min to 10 min.

Optionally, the expected defrosting time is 3 min to 4 min.

Optionally, the number n of executed defrosting cycles returns to zero when a running mode of the heat pump system is switched, or the heat pump system is powered off and restarted.

To realize the objectives of this application, according to another aspect of this application, a heat pump system is further provided, which performs defrosting control using the defrosting control method described above.

In the heat pump system and the defrosting control method according to this application, by introducing the restriction of a preset defrosting interval indicatrix $X=T_1/TM_n+T_2/TN_n$, a first default parameter and a second default parameter in the preset defrosting interval indicatrix are adjusted when an actual defrosting time deviates from an expected defrosting time, so that a defrosting interval can be adjusted effectively to conform to an actual application situation, thus achieving a balance between unit performance and comfort degree of customers.

DETAILED DESCRIPTION

Figure 1:
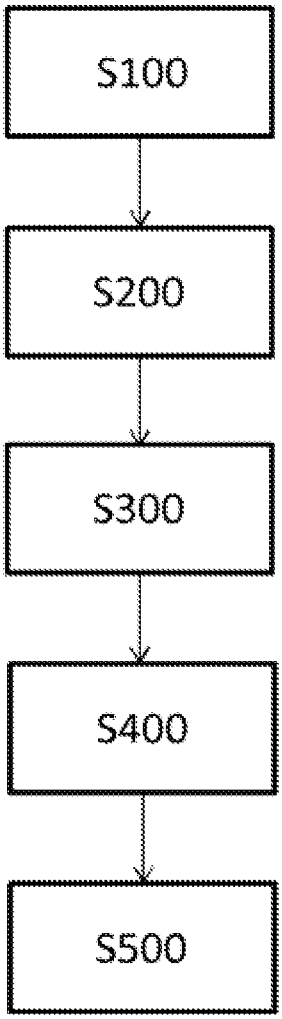
FIG. 1 is a schematic diagram of control steps of a defrosting control method for a heat pump system according to this application.
Figure 2:
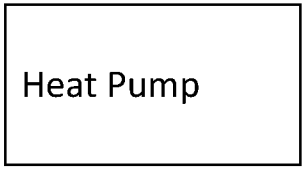
FIG. 2 shows a heat pump system in an example embodiment.

Referring to FIG. 1, a schematic diagram of control steps of a defrosting control method for a heat pump system is shown. An example heat pump system is shown in FIG. 2. Specifically, the method at least includes the following steps: in S100, initializing a first default parameter $TM_n$ and a second default parameter $TN_n$ in a preset defrosting interval indicatrix X when a heat pump system runs; in S200, executing the defrosting cycle when the preset defrosting interval indicatrix X is greater than or equal to a preset constant value, and terminating the defrosting cycle after a defrosting cycle exit condition is met; in S300, obtaining an actual time spent on the defrosting cycle; in S400, comparing the actual time spent on the defrosting cycle with an expected defrosting time, and adjusting the first default parameter and the second default parameter when the actual defrosting time deviates from the expected defrosting time; and in S500, repeating steps S200 to S400.

In the heat pump system and the defrosting control method according to this application, by introducing the restriction of a preset defrosting interval indicatrix, a first default parameter and a second default parameter in the preset defrosting interval indicatrix are adjusted when an actual defrosting time deviates from an expected defrosting time, so that a defrosting interval can be adjusted effectively to conform to an actual application situation, thus achieving a balance between unit performance and comfort degree of customers.

Specifically, the preset defrosting interval indicatrix $X=T_1/TM_n+T_2/TN_n$, wherein X is greater than or equal to the preset constant value. $T_1$ represents a running time of the heat pump system when an outdoor temperature is greater than or equal to an outdoor temperature preset value; $TM_n$ represents the first default parameter; $T_2$ represents a running time of the heat pump system when the outdoor temperature is less than the outdoor temperature preset value; $TN_n$ represents the second default parameter; and n represents the number of executed defrosting cycles. When the heat pump system runs at a temperature greater than or equal to a certain outdoor temperature preset value, as the environment temperature is relatively high, the humidity is also relatively high. Therefore, a frost layer with a certain thickness is formed more easily. In this case, a corresponding first default parameter should be set to ensure that the preset defrosting interval indicatrix can be used for indicating an expected defrosting interval when the temperature is higher than the outdoor temperature preset value. In addition, when the heat pump system runs at a temperature lower than a certain outdoor temperature preset value, as the environment temperature is relatively low, the air is dryer and the humidity is also relatively low. Therefore, it is difficult to form a frost layer with a certain thickness. In this case, a corresponding second default parameter should be set to ensure that the preset defrosting interval indicatrix can be used for indicating an expected defrosting interval when the temperature is lower than the outdoor temperature preset value. The preset constant value mentioned in the preset defrosting interval indicatrix X is used for providing a normative standard to check whether a variable, i.e., the heat hump actual running time, in the function meets a defrosting requirement. For example, the preset constant value is set to 100%. In other words, it is considered that when the running time $T_1$ of the heat pump system is equal to $TM_n$ in a working condition where the outdoor temperature is greater than or equal to the outdoor temperature preset value, a frost situation on the condenser has reached such a degree that defrosting needs to be performed 100% as considered by the designer. Alternatively, when the running time $T_2$ of the heat pump system is equal to $TN_n$ in a working condition where the outdoor temperature is less than the outdoor temperature preset value, a frost situation on the condenser also has reached such a degree that defrosting needs to be performed 100% as considered by the designer. Alternatively, when the running time $T_1$ of the heat pump system is equal to $\frac{1}{2}TM_n$ in a working condition where the outdoor temperature is greater than or equal to the outdoor temperature preset value and the running time $T_2$ of the heat pump system is equal to $\frac{1}{2}TN_n$ in a working condition where the outdoor temperature is less than the outdoor temperature preset value, as X=50%+50%=100%, a frost situation on the condenser also has reached such a degree that defrosting needs to be performed 100% as considered by the designer.

The parameters in the defined preset defrosting interval indicatrix and effects of the parameters will be described below more intuitively with examples.

For example, an optional outdoor temperature preset value is −5° C. to −10° C.; and/or the first default parameter is 20 to 40; and/or the second default parameter is 40 to 80. A group of data is selected from the set protection ranges to illustrate the meaning of the settings. Here, the outdoor temperature preset value is set to −8° C., the first default parameter is set to 30, and the second default parameter is set to 60. That is, when the heat pump system runs at a temperature higher than or equal to −8° C., it can be basically considered that the humidity at this temperature is relatively high, and therefore a frost layer with a certain thickness can be formed on the condenser after a relatively short running time. In this case, a relatively small number, such as 30, should be provided as the first default parameter. It indicates that every time after the heat pump system runs for 30 min at a temperature greater than or equal to −8° C., the control system considers that the frost layer accumulated on the condenser has reached an inappropriate thickness, and a defrosting mode needs to be executed. When the heat pump system runs at a temperature lower than −8° C., it can be basically considered that the humidity at this temperature is relatively low, and therefore a frost layer with a certain thickness is formed on the condenser only after a relatively long running time. In this case, a relatively large number such as 60 should be provided as the second default parameter. It indicates that every time after the heat pump system runs for 60 min at a temperature lower than −8° C., the control system considers that the frost layer accumulated on the condenser has reached an inappropriate thickness, and a defrosting mode needs to be executed.

An expression of the preset defrosting interval indicatrix has been provided as above. When the defrosting cycle is executed for the $n^{th}$ time, in the corresponding preset defrosting interval indicatrix, the first default parameter $TM_n=TM_{n-1}+a*c$, and the second default parameter $TM_n=TN_{n-1}+a*c$, wherein a represents a preset time unit, and c represents a third default parameter. That is, to make sure that an execution time of the defrosting cycle is in a suitable range, the defrosting interval of each execution needs to be adjusted according to an actual situation. In the expression, the first default parameter/second default parameter of each execution needs to have a time variation of c preset time units a with respect to the previous first default parameter/second default parameter, that is, the first default parameter/second default parameter of each execution may be increased or decreased by the duration of a*c units with respect to the previous first default parameter/second default parameter.

More specifically, when the actual defrosting time is less than the expected defrosting time, c=1; that is, the defrosting interval can be increased by adding the duration of a to the first default parameter/second default parameter. When the actual defrosting time is equal to the expected defrosting time, c=0; that is, the current defrosting interval is suitable, and the first default parameter/second default parameter can remain unchanged. When the actual defrosting time is greater than the expected defrosting time, c=−1; that is, the defrosting interval can be decreased by subtracting the duration of a from the first default parameter/second default parameter.

In another aspect, optionally, the preset time unit a is set to 5 min to 10 min, that is, the minimum change unit of the defrosting interval is 5 min to 10 min each time.

Optionally, a minimum value is further set for the first default parameter/second default parameter to avoid problems in the first default parameter/second default parameter in some extreme cases or fault conditions, for example, the first default parameter/second default parameter becomes a negative number, or frequent starts and stops caused by an extremely short interval. An expression of the minimum value is as follows: when $TM_{n-1}+a*c<TM_{min}$, $TM_n$ is taken as a minimum value $TM_{min}$; and when $TN_{n-1}+a*c<TN_{min}$, $TN_n$ is taken as a minimum value $TN_{min}$. More specifically, the minimum value $TM_{min}$=30 min; and the minimum value $TN_{min}$=30 min.

In addition to the expression of the preset defrosting interval indicatrix, the defrosting control method further includes a plurality of control parameters having meaningful settings, as well as a plurality of control steps. The control parameters and control steps will be illustrated as follows.

For example, a plurality of defrosting cycle exit conditions are set here. On one hand, when the condenser temperature is greater than 12° C. to 16° C., it can be considered that an expected defrosting effect has been reached, and the defrosting cycle can be exited. On the other hand, when the actual defrosting time is greater than 6 min to 10 min, it is also necessary to exit the defrosting cycle first and resume heating in consideration that users may feel uncomfortable if heating is off for a long time For another example, when a running mode of the heat pump system is switched, or the heat pump system is powered off and restarted, the number n of the executed defrosting cycles returns to zero. That is, the preset defrosting interval indicatrix is initialized, so that it can be applied to the commonest scenario.

For another example, an optional expected defrosting time is 3 min to 4 min, because it is difficult to completely remove the frost layer if the defrosting time is too short, while heating will be off for a long time if the defrosting time is too long, which easily affects comfort degree of customers.

Although not shown in the FIGURE, according to another aspect of this application, a heat pump system is further provided, which can use the defrosting control method and therefore can achieve the corresponding technical effect. It should be noted that the purpose of the defrosting control method is adjusting the defrosting interval, so that it better conforms to the actual application situation, while the specific defrosting pipeline layout or defrosting means is not limited.

In the prior art, the heat pump system can have various structures and methods for executing a defrosting cycle. For example, heating can be stopped and a four-way valve can be reversed to introduce a high-temperature gas refrigerant on the condenser side, so as to dissipate heat and defrost. For another example, a bypass branch can be opened at a vent end of a compressor to introduce a high-temperature gas refrigerant into the condenser side, so as to dissipate heat and defrost. Any embodiment or a combination of the embodiments of this application is fully applicable to these different situations and brings about corresponding technical effects.

The above examples mainly illustrate the defrosting control method and the heat pump system of this application. Some implementations of this application are described. However, those of ordinary skill in the art should understand that this application can be implemented in many other forms without departing from the subject and scope thereof. Therefore, the displayed examples and implementations are considered as exemplary instead of limitative, and this application can incorporate various modifications and replacements without departing from the spirit and scope of this application as defined in the appended claims.

What is claimed is:

1. A defrosting control method for a heat pump system, the method comprising:

in S100, initializing a first default delay time interval $TM_n$ and a second default delay time interval $TN_n$ in a preset defrosting interval indicatrix X when the heat pump system runs, wherein the preset defrosting interval indicatrix $X=T_1/TM_n+T_2/TN_n$, $T_1$ represents a running time of the heat pump system when an outdoor temperature is greater than or equal to an outdoor temperature preset value, $T_2$ represents a running time of the heat pump system when the outdoor temperature is less than the outdoor temperature preset value, and n represents the number of executed defrosting cycles;

in S200, executing the defrosting cycle when the preset defrosting interval indicatrix X is greater than or equal to a preset constant value, and terminating the defrosting cycle after a defrosting cycle exit condition is met;

in S300, obtaining an actual time spent on the defrosting cycle;

in S400, comparing the actual time spent on the defrosting cycle with an expected defrosting time, and adjusting the first default parameter and the second default parameter when the actual defrosting time deviates from the expected defrosting time; and in S500, repeating steps S200 to S400.

2. The defrosting control method according to claim 1, wherein the outdoor temperature preset value is −5° C. to −10° C.; and/or the first default delay time interval is 20 minutes to 40 minutes; and/or the second default delay time interval is 40 minutes to 80 minutes.

3. The defrosting control method according to claim 1, wherein the preset constant value is 100%.

4. The defrosting control method according to claim 1, wherein the defrosting cycle exit condition is that a condenser temperature is greater than 12° C. to 16° C., or the actual defrosting time is greater than 6 min to 10 min.

5. The defrosting control method according to claim 1, wherein the expected defrosting time is 3 min to 4 min.

6. The defrosting control method according to claim 1, wherein the number n of executed defrosting cycles returns to zero when a running mode of the heat pump system is switched, or the heat pump system is powered off and restarted.

7. A heat pump system, wherein defrosting control is performed by using the defrosting control method according to claim 1.

* * * * *